US007137836B2

(12) United States Patent
Lu et al.

(10) Patent No.: US 7,137,836 B2
(45) Date of Patent: Nov. 21, 2006

(54) CARD CONNECTOR WITH DETECT SWITCH

(75) Inventors: Yao-Pang Lu, Tu-cheng (TW); Wen-Qiang Ma, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/259,805

(22) Filed: Oct. 27, 2005

(65) Prior Publication Data

US 2006/0089052 A1 Apr. 27, 2006

(30) Foreign Application Priority Data

Oct. 27, 2004 (CN) ..... 2004 2 0806749

(51) Int. Cl.
*H01R 29/00* (2006.01)

(52) U.S. Cl. ..... 439/188; 439/489

(58) Field of Classification Search ..... 439/188, 439/489, 630
See application file for complete search history.

(56) References Cited

U.S. PATENT DOCUMENTS 5,330,363 A * 7/1994 Gardner et al. ..... 439/188
6,336,588 B1 * 1/2002 Reichardt et al. ..... 235/475
6,431,893 B1 * 8/2002 Chang et al. ..... 439/188
6,692,276 B1 * 2/2004 Abe et al. ..... 439/188
6,805,566 B1 * 10/2004 Chia-Chen ..... 439/188
6,816,386 B1 * 11/2004 Oguchi et al. ..... 361/769
6,899,557 B1 * 5/2005 Hirata ..... 439/188
2004/0192096 A1 * 9/2004 Sato et al. ..... 439/188
2004/0209506 A1 * 10/2004 Kawahata et al. ..... 439/188
2005/0059281 A1 * 3/2005 Bricaud et al. ..... 439/188

* cited by examiner

*Primary Examiner*—Tulsidas C. Patel
*Assistant Examiner*—Vladimir Imas
(74) *Attorney, Agent, or Firm*—Wei Te Chung

(57) ABSTRACT

A memory card connector adapted for connecting a memory card to a PCB comprises an insulative housing (10) defining a receiving portion for receiving a memory card therein, a plurality of terminals (20) received in the housing, a switch contact (40) received in a front corner portion of the housing, and a metal cover (30) enclosing the housing. The switch contact includes an engaging arm (41) extending opposite to the card insertion direction. The metal cover includes a side plate (35) secured in a side portion of the housing and a flexible beam (38) extending forwardly and inwardly from a front end of the side plate. The flexible beam includes a contact portion (383) spaced from the engaging arm of the switch contact and deflectable upon insertion of the memory card to contact with the engaging arm of the switch contact.

5 Claims, 4 Drawing Sheets

CARD CONNECTOR WITH DETECT SWITCH

FIELD OF THE INVENTION

The present invention generally relates to a card connector, and more particularly to a card connector with a detect switch.

BACKGROUND OF THE INVENTION

Memory cards are widely used with electronic devices, especially with portable consumer devices such as PDAs, Cameras, mobile phones et al. Card connectors for connecting the memory cards to the electronic devices usually have switch means for detect presence of the memory cards. Since the electronic devices are required to be more and more small in size, the memory cards are desired to be smaller too, and so do the card connectors. Sensitive detection of the small cards is a task for designer of the card connectors.

BRIEF SUMMARY OF THE INVENTION

A main object of the present invention is to provide a card connector have a sensitive detect switch.

A memory card connector adapted for connecting a memory card to a PCB comprises an insulative housing defining a receiving portion for receiving a memory card therein, a plurality of terminals received in the housing, a switch contact received in a front corner portion of the housing, and a metal cover enclosing the housing. The switch contact includes an engaging arm extending opposite to the card insertion direction. The metal cover includes a side plate secured in a side portion of the housing and a flexible beam extending forwardly and inwardly from a front end of the side plate. The flexible beam includes a contact portion spaced from the engaging arm of the switch contact and deflectable upon insertion of the memory card to contact with the engaging arm of the switch contact.

Other objects, advantages and novel feather of the invention will become more apparent from the following detailed description when taken in conjunction with the accompanying drawings.

DETAILED DESCRIPTION OF THE INVENTION

FIGS. 1–4 shows a card connector 1 according to a preferred embodiment of the present invention. In this embodiment, the card connector 1 is a Subscriber Identification Module (SIM) Card connector mounted on a PCB (not shown) for connecting a SIM card to a Mobile device or the like. The SIM Card has an inclined corner portion thereof.

Figure 3:
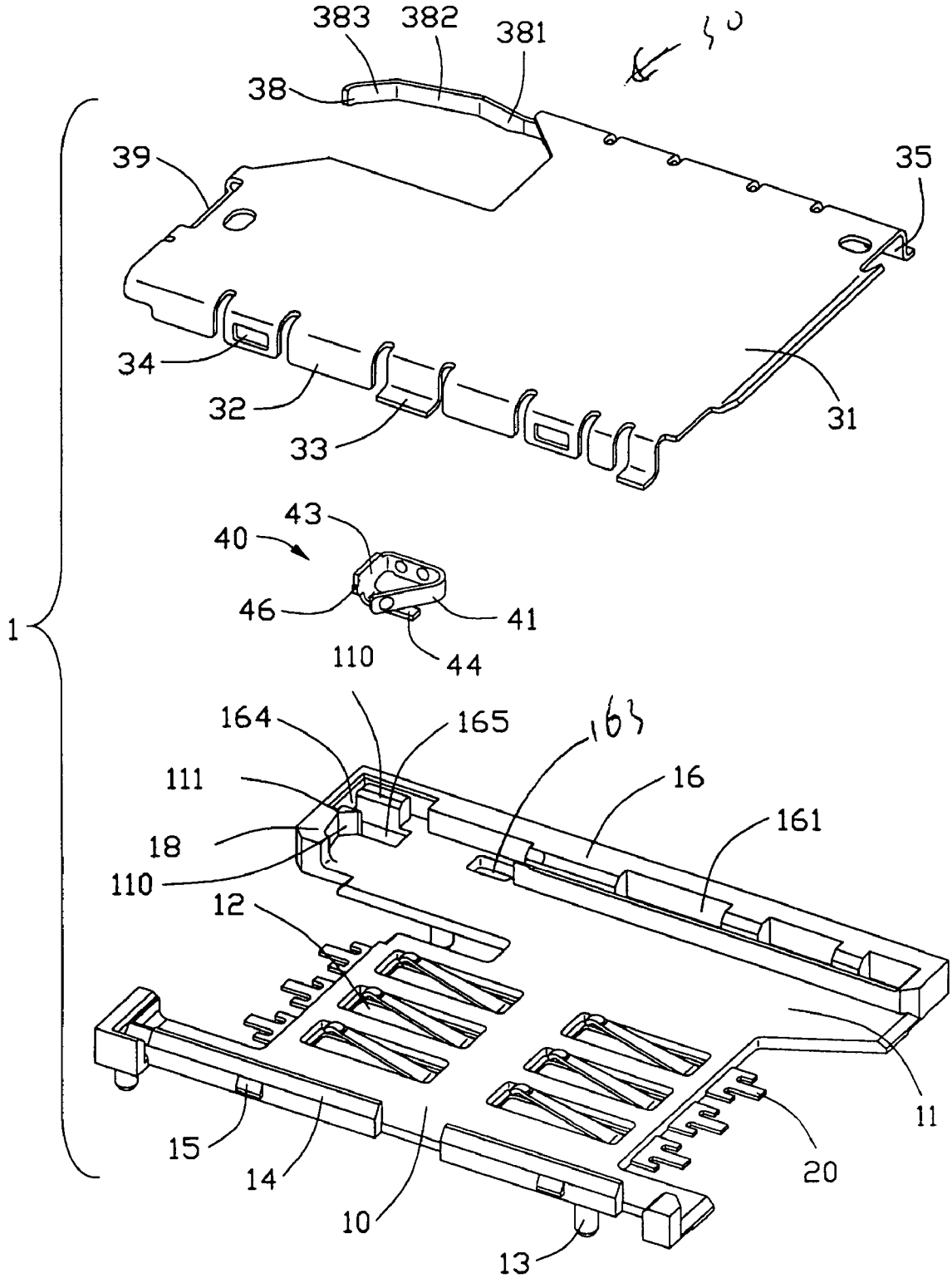
FIG. 3 is an exploded view of FIG. 1.
Figure 4:
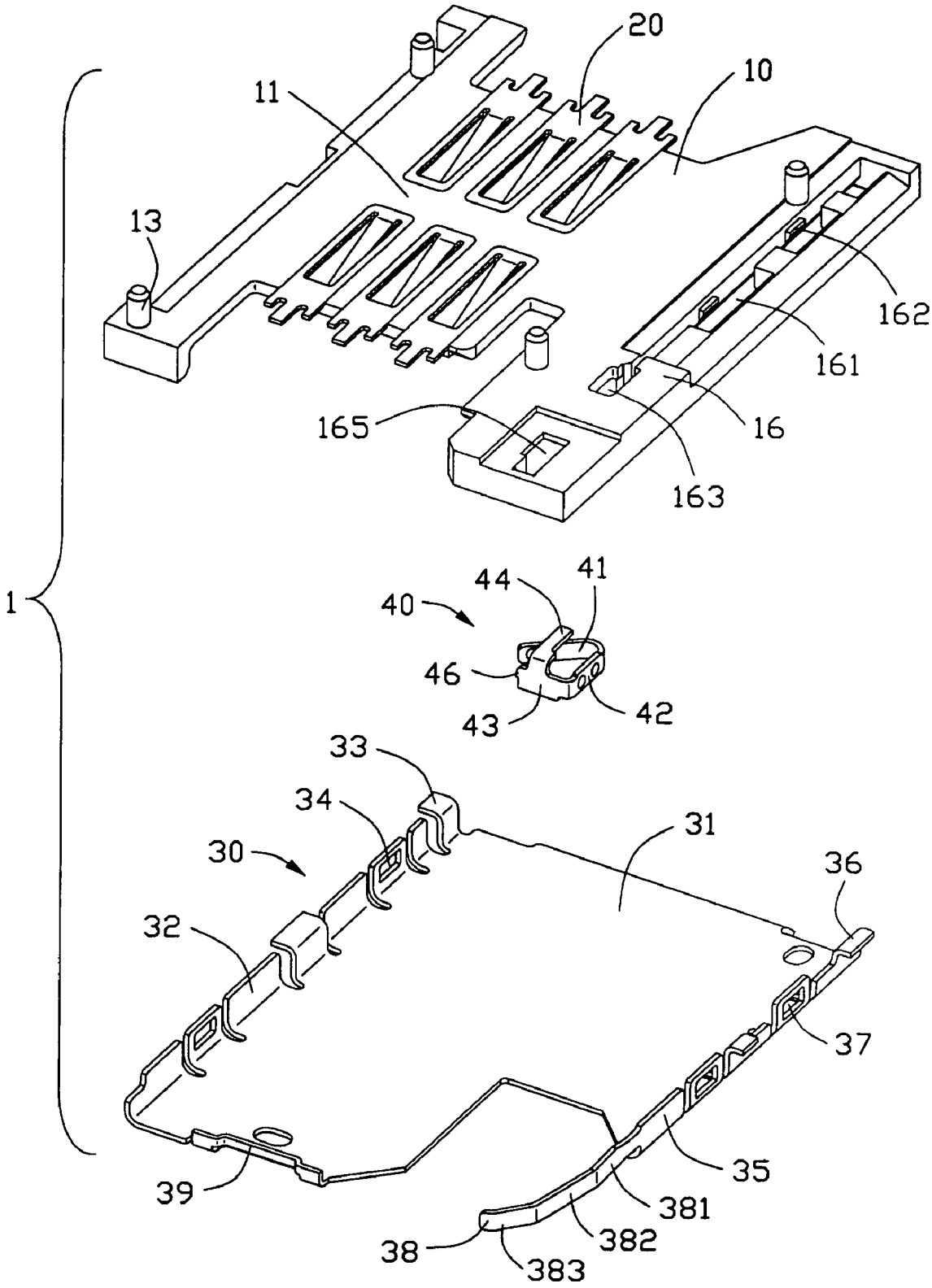
FIG. 4 is an exploded view of FIG. 2.

Referring to FIG. 3–4, the card connector 1 includes an insulative housing 10, plurality of conductive terminals 20 mounted in the housing 10, a metal cover 30 adapted for covering a substantial portion the housing 10, and a switch mechanism for detecting insertion of a SIM card.

The housing 10 includes a substantially rectangular plate like base 11, a first and a second side walls 14, 16 extending along opposite sides of the base 11, a front wall 18 extending along a front edge of the base 11, and a receiving portion (not labeled) between the side walls 14, 16 for receiving the SIM card therein. The base 11 defines a plurality of receiving passageways 12 extending through upper and lower surfaces thereof. A plurality of mounting post 13 extending downwardly from the lower surface of the base 11. At least one retaining wedge 15 extending outwardly from an outer surface of the first side wall 14, while the second side wall 16 defines a longitudinal first mounting slot 161 extending from an rear portion to a substantially middle portion of the second side wall 16. A plurality of retaining protrusions 162 are defined on the lower surface of the second side wall 16 and adjacent to the mounting slot 161. A second mounting slot 163 is defined in the second side wall 16 in front of the first mounting slot 161. A substantially rectangular block 110 projection upwardly from a front portion of the base 11 adjacent to both the front wall 18 and the second side wall 16 but spaced from the front wall 18 and the second side wall 16, thereby defining a right angled retaining groove 164 therein. A triangular stopper 111 protrudes from the front wall 18 toward the block 110 and has an inclined surface 1110 angularly extends from a rear surface of the front wall 18. The base 11 defines a through hole 165 between the block 110 and the stopper 111.

Each conductive terminal 20 includes a retaining portion (not labeled) secured with the housing 10, a contact portion extending through a corresponding receiving passageway 12 into the opening for engaging with the inserted SIM card, and a solder tail portion extending outwardly for being soldered to a printed circuit board (not shown) of the electronic device. In the present preferred embodiment, the conductive terminals 20 are insert-molded with the housing 10.

The metal cover 30 is stamped from an unitary metal piece and includes a main body plate 31, a first and a second side plate 32, 35 extending downwardly from opposite sides of the body plate 31, and a stopper plate 39 extending downwardly from a front edge of the body plate 31. The side plates 32 35 defines a plurality of cutouts 34, 37 therein. A plurality of solder tabs 33, 36 extend laterally from the side plates 32, 35. The second side plate 35 is shorter than the first side plate 32 and a flexible beam 38 extends forwardly from a front portion of the second side wall 35. The flexible beam 38 includes a first curved portion 381 adjacent to the second side wall 35, a flexible contact portion 383 at a distal end portion thereof, and a second curved portion 382 between the first and curved portion 381 and the contact portion 383. The first curved portion 381 extends forwardly and outwardly from a front end of the second side wall 35. The second curved portion 382 extends forwardly and inwardly from a front end of the first curved portion 381. The flexible contact portion 383 extends forwardly and inwardly from a front end of the third curved portion 382.

The switch contact 40 is stamped and folded from a metal strip and includes a vertical retaining portion 43, a solder tail portion 44 extends horizontally from a lower portion of the retaining portion 43, and a substantial U-shaped flexible portion extends from an lateral end of the retaining portion 43. The U-shaped flexible portion includes a longitudinal portion 42 extends rearwardly from the lateral end of the retaining portion 43 and an engaging arm 41 extends forwardly and inwardly from the longitudinal portion 42.

Figure 1:
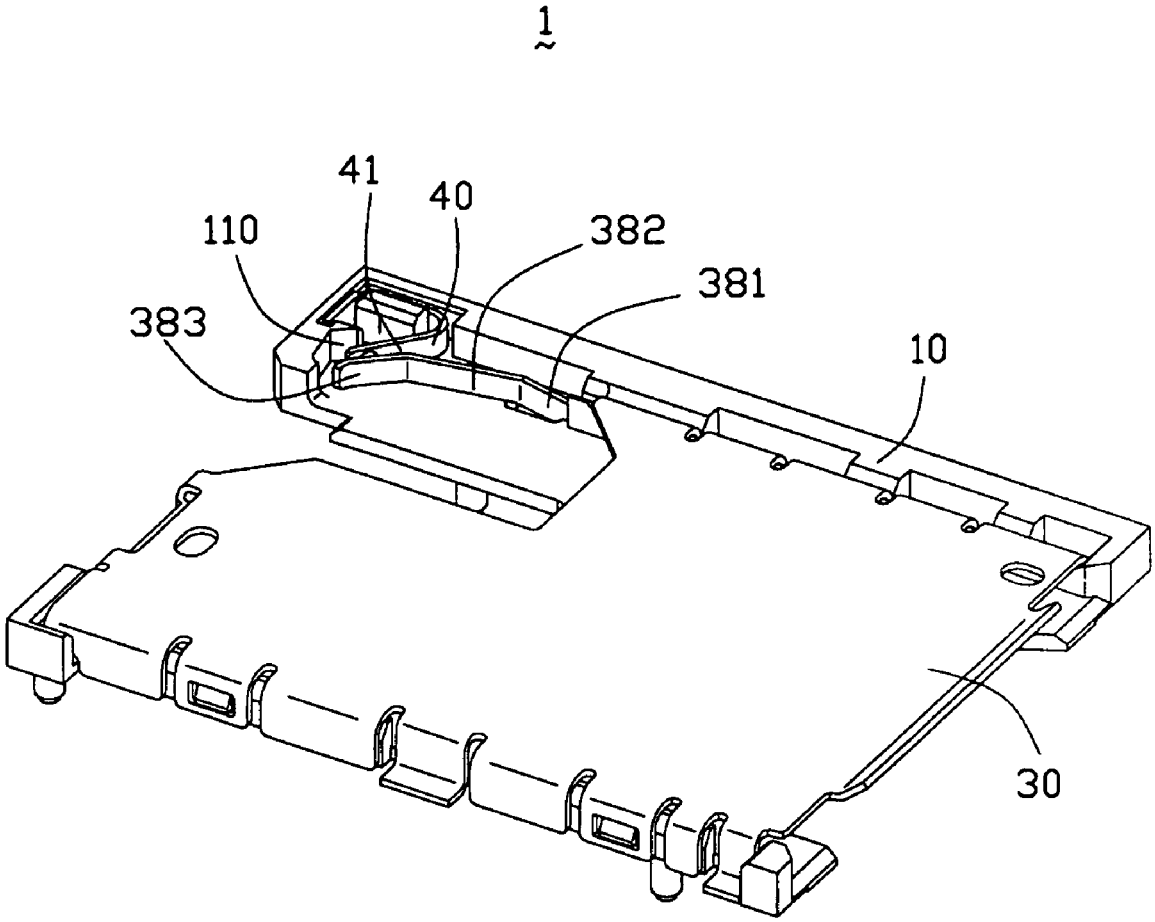
FIG. 1 is a perspective view of a card connector according to a preferred embodiment of the present invention.
Figure 2:
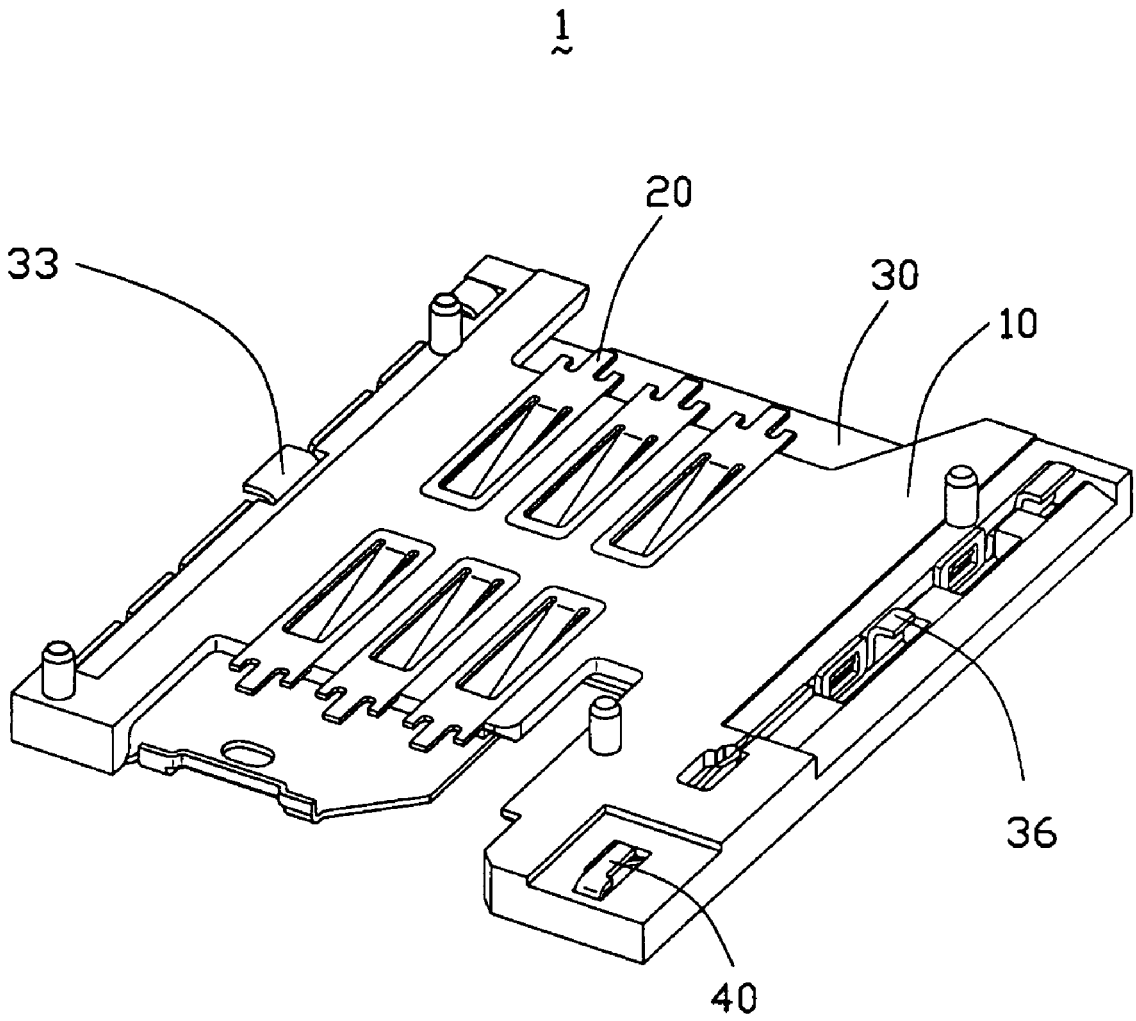
FIG. 2 is another perspective view of the SIM card connector of FIG. 1 from a bottom aspect.

Referring to FIGS. 1 and 2, in assembly, the switch contact 40 is mounted on the housing 10 and substantially surrounds the block 110. The retaining portion 43 and the longitudinal portion 42 is retained in the L-shaped retaining groove 164, the engaging arm 41 extends forwardly and inwardly from a rear end of the retaining groove 164 and substantially parallel to the inclined surface 110 of the stopper 11, and the solder tail portion 44 extends downwardly through the through hole 165 for being soldered to the PCB. The engaging arm 41 is spaced from and pressible to engaging with the inclined surface 110 of the stopper 111.

The metal cover 30 is attached to the housing 10. The first sidewall engages an outer periphery of the first side wall 14 of the housing 10, with the cutouts 34 engaging with corresponding retaining wedges 15. The second side plate 35 of the cover 30 extends through the longitudinal first mounting slot 161 of the second side wall 16 of the housing 10. The cutouts 37 respectively engage with the corresponding protrusions 162. The first curved portion 381 of the flexible beam 38 is retained in the second mounting slot 161. The contact portion 383 extends parallel with and spaced from the engaging arm 41.

During insertion of the SIM card, the inclined corner portion of the SIM card firstly engages with the contact portion 383 of the flexible beam 38, and urges the contact portion 383 to move forwardly and come into engaging with the engaging arm 41 of the switch contact 40, whereby the switch is initiated. Further insert the SIM card, the engaging arm 41 is pushed forwardly to come into engaging with the inclined surface 110 of the stopper 111.

It is to be understood, however, that even though numerous, characteristics and advantages of the present invention have been set forth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

The invention claimed is:

1. A memory card connector adapted for connecting a memory card to a PCB comprises:

an insulative housing defining a receiving portion for receiving a memory card therein;

a plurality of terminals received in the housing, each terminal including a contact portion extending into the receiving portion of the housing for electrically engaging with the memory card;

a switch contact received in a front corner portion of the housing, the switch contact including an engaging arm extending opposite to the card insertion direction; and a metal cover including a main body for substantially enclosing the receiving portion of the housing and a side plate secured in a side portion of the housing, a flexible beam extending forwardly and inwardly from a front end of the side plate, the flexible beam including a contact portion spaced from the engaging arm of the switch contact and deflectable upon insertion of the memory card to contact with the engaging arm of the switch contact, wherein said housing includes a front wall, the front wall forming a stopper, the stopper having an inclined surface, said engaging arm of the switch contact extending rearwardly beyond the inclined surface and coming into contacting with the inclined surface upon insertion of the memory card.

2. The card connector according to claim 1, wherein the flexible beam further includes a first curved portion and a second curved portion, the first curved portion extending forwardly and slightly outwardly from the front end of the side plate, the second curved portion extending forwardly and inwardly from a front end portion of the first curved portion, said contact portion extending forwardly and inwardly from a front end portion of the second curved portion.

3. A card connector adapted for connecting a memory card to a PCB comprises:

an insulative housing having a first side wall, a second side wall, and a receiving portion defined between the first and second side walls for receiving a memory card therein, a plurality of terminals received in the housing, each terminal including a contact portion extending into the receiving portion of the housing for electrically engaging with the memory card;

a switch contact received in the housing, the switch contact including an engaging arm; and a metal cover including a main body for substantially enclosing the receiving portion of the housing, a first side plate and a second side plate respectively attached to the first and second side walls of the housing, the second side plate being shorter than the first side plate, a flexible beam extending forwardly from a substantially frontmost end of the second side plate, the flexible beam including a contact portion interacting with the engaging arm of the switch contact in an engaging or non-engaging manner, substantially in a card insertion direction, according to whether or not a memory card is inserted into the receiving portion to deflect the contact portion of the flexible beam.

4. The card connector according to claim 3, wherein the second side wall of the housing defining a retaining slot in an upper portion thereof and adjacent to the receiving portion, the first side plate of the metal cover being secured to an outer periphery of the first side wall of the housing, the second side plate being secured in the retaining slot of the second side wall of the housing.

5. A card connector assembly comprising:

an insulative housing;

a metallic shell attached to the housing and cooperating with said housing to define a card receiving space therebetween, said shell including at a rear portion thereof a deflectable beam extending into the card receiving space;

a plurality of terminals disposed in the housing with contacting portions extending into the card receiving space;

a discrete contact positioned around said card receiving space and including a mounting section for mounting to a printed circuit board and an engagement section confronting the deflectable beam; wherein the engagement section and the detectable beam internet with each other in an engaging or non-engaging manner according to whether a card is inserted into the card receiving space to deflect said beam; wherein said discrete contact is located at a rear corner of the housing, and the deflectable beam is located on an inner side of said engagement section.

* * * * *